US009124027B2

(12) United States Patent
Miki et al.

(10) Patent No.: US 9,124,027 B2
(45) Date of Patent: Sep. 1, 2015

(54) CARD EDGE CONNECTOR, CARD TYPE MODULE, AND CONNECTOR

(71) Applicant: FUJITSU COMPONENT LIMITED, Tokyo (JP)

(72) Inventors: Yasuyuki Miki, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 10 days.

(21) Appl. No.: 14/147,709

(22) Filed: Jan. 6, 2014

(65) Prior Publication Data

US 2014/0193994 A1 Jul. 10, 2014

(30) Foreign Application Priority Data

Jan. 9, 2013 (JP) ..... 2013-002045

(51) Int. Cl.

| | |
|---|---|
| ***H01R 13/62*** | (2006.01) |
| ***H01R 13/621*** | (2006.01) |
| ***H01R 12/72*** | (2011.01) |
| ***H01R 13/635*** | (2006.01) |
| *H01R 12/50* | (2011.01) |

(52) U.S. Cl.

CPC ..... *H01R 13/621* (2013.01); *H01R 12/721* (2013.01); *H01R 13/635* (2013.01); *H01R 23/7005* (2013.01)

(58) Field of Classification Search

CPC ..... H01R 12/721; H01R 13/639; H01R 31/06
USPC ..... 439/372, 325, 327, 155, 152, 362, 364
See application file for complete search history.

(56) References Cited

U.S. PATENT DOCUMENTS

| | | | | |
|---|---|---|---|---|
| 4,318,157 | A * | 3/1982 | Rank et al. | 361/704 |
| 5,213,532 | A * | 5/1993 | Mee | 439/364 |
| 5,470,240 | A | 11/1995 | Suzuki | |

FOREIGN PATENT DOCUMENTS

JP 06-086278 U 12/1994

* cited by examiner

*Primary Examiner* — Abdullah Riyami
*Assistant Examiner* — Nelson R Burgos-Guntin
(74) *Attorney, Agent, or Firm* — IPUSA, PLLC

(57) ABSTRACT

A card edge connector includes a connector including a target engagement part, a substrate that can be inserted into and removed from the connector, a fixing part fixed to the substrate, and a lock that secures the substrate to the connector. The lock includes a shaft fixed to the fixing part and configured to slide in the direction of insertion and removal of the substrate and rotate around an axis, an urging part that exerts force on the shaft and biasing the shaft toward the direction of the substrate, and an engagement part provided on the shaft, configured to engage the target engagement part.

9 Claims, 10 Drawing Sheets

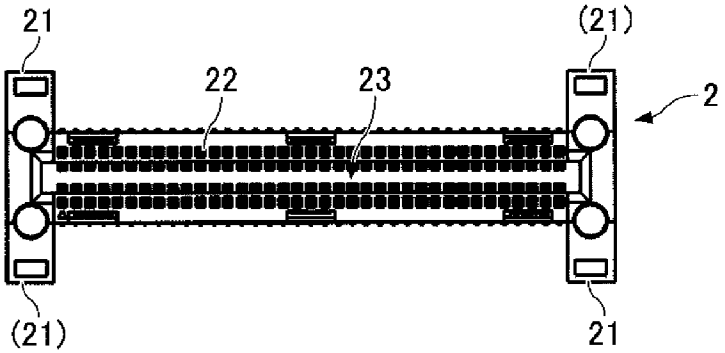
FIG.6C
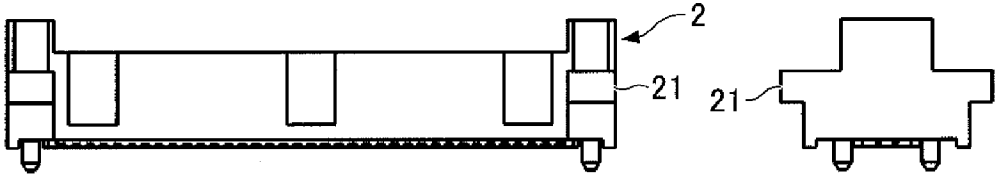
FIG.6A
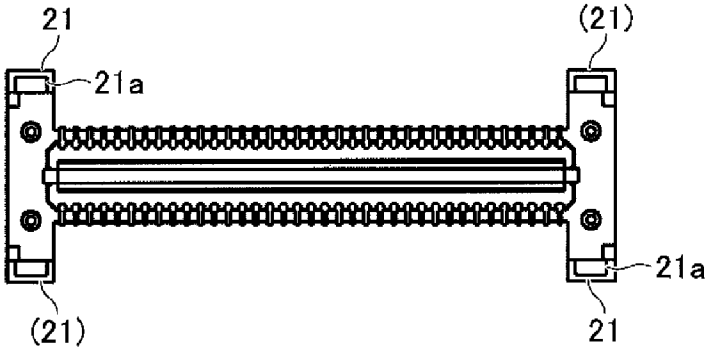
FIG.6B
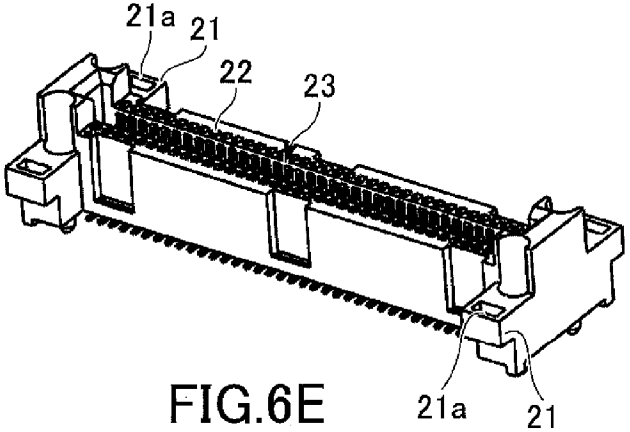
FIG.6D
FIG.6E

CARD EDGE CONNECTOR, CARD TYPE MODULE, AND CONNECTOR

CROSS-REFERENCE TO RELATED APPLICATIONS

This application is based upon and claims the benefit of priority of the prior Japanese Patent Application No. 2013-002045 filed on Jan. 9, 2013, the entire contents of which are hereby incorporated by reference.

BACKGROUND

1. Field of the Invention

The present invention generally relates to a card edge connector including a substrate having pads provided on its end part (card edge) and a connector having contacts corresponding to the pads, a substrate used for the card edge connector, and a connector used for the card edge connector.

2. Description of the Related Art

A conventional card edge connector includes multiple conductive contacts arranged in parallel on the sides of a connector, multiple insulators for containing the contacts, and a substrate corresponding to the connector that includes multiple conductive pads corresponding to the multiple conductive contacts. A card edge connector disclosed in Japanese Laid-Open Utility Model Publication No. 6-86278, which includes a connector and a substrate, has a pair of latch type levers provided on the sides of the connector and a pair of notches provided on the sides of the substrate corresponding to protrusions of the pair of latch type levers. After inserting the substrate into the connector, the protrusions are engaged with the notches by pivotally rotating the pair of latch type levers. Thereby, the substrate is fixed to the connector.

The card edge connector disclosed in Japanese Laid-Open Utility Model Publication No. 6-86278 includes notches and protrusions to serve as an engagement structure for fixing the substrate into the connector. Because the protrusions are to engage the notches by pivotally rotating the latch type levers after inserting the substrate to the connector, the card edge connector requires a clearance to be provided between the protrusions and the notches in an insertion/removal direction. Therefore, the card edge connector requires pads to have an additional length that is long enough to absorb looseness in the insertion/removal direction caused by the clearance after the substrate is mounted on the connector. However, this may cause the generation of branched portions at the contact points (a stub) formed by the pads and the contacts. The branched portions could become a by-pass of a signal transmission path and adversely affect high speed transmission.

SUMMARY

An embodiment of the present invention provides a card edge connector including a connector including a target engagement part, a substrate that can be inserted into and removed from the connector, a fixing part fixed to the substrate, and a lock that secures the substrate to the connector. The lock includes a shaft fixed to the fixing part and configured to slide in the direction of insertion and removal of the substrate and rotate around an axis, an urging part that exerts force on the shaft and biasing the shaft toward the direction of the substrate, and an engagement part provided on the shaft, configured to engage the target engagement part.

Other objects and further features of the present invention will be apparent from the following detailed description when read in conjunction with the accompanying drawings.

BRIEF DESCRIPTION OF THE DRAWINGS

FIGS. 6A-6E illustrate a connector of the card edge connector according to the first embodiment of the present invention;

DESCRIPTION OF EMBODIMENTS

In the following, embodiments of the present invention are described with reference to the accompanying drawings.

Figure 1:
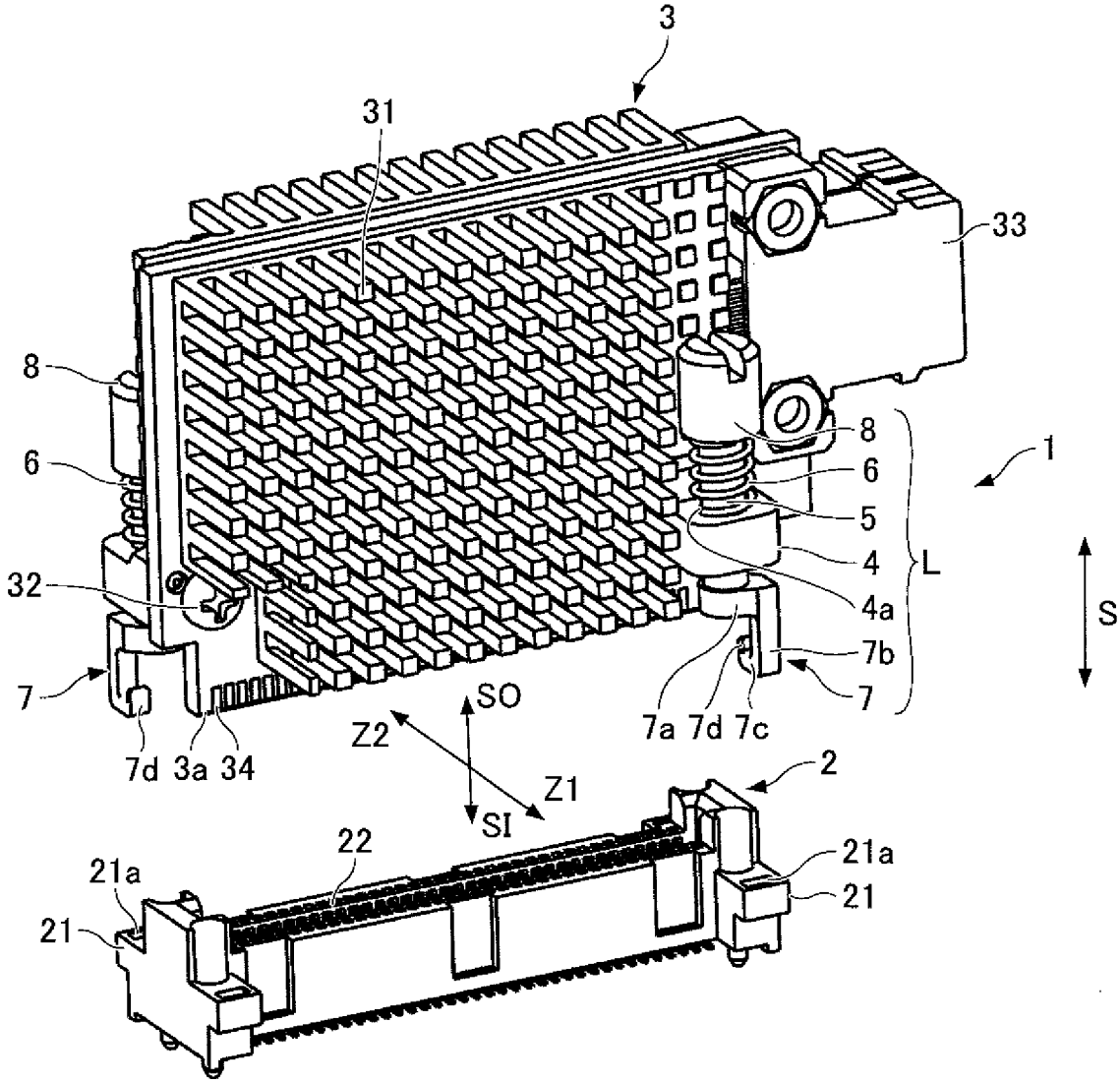
FIG. 1 is a perspective view illustrating a card edge connector according to a first embodiment of the present invention.

As illustrated in FIG. 1, a card edge connector 1 according to a first embodiment of the present invention includes a connector 2, a card module (an example of substrate) 3. A fixing block (fixing part) 4, a shaft 5, and a coil spring 6 are provided on the card module 3. The card module 3 includes a substrate onto which a circuit is formed, and electric components may be installed thereon. The card module 3 can be inserted to and removed from the connector 2 in an insertion/removal direction S. The connector 2 includes a target engagement part 21.

The fixing block 4 is fixed to the card module 3 and includes an insertion hole 4*a*. The shaft 5 is inserted to the insertion hole 4*a* and can slide in an insertion/removal direction S. The shaft 5 is also rotatably coupled to the insertion hole 4*a* to rotate around its axis that is oriented in the insertion/removal direction S. The coil spring (urging part) 6 exerts force on the shaft 5 in a removing direction SO of the insertion/removal direction S. A lock (engagement part) 7 that can be engaged with the target engagement part 21 is formed on the shaft 5, extending toward an inserting direction SI of the insertion/removal direction S.

As illustrated in FIG. 1, an operation part 8 that can be operated with a flat head screwdriver is formed on or coupled to the shaft 5 toward the removal direction SO. The coil spring 6 is secured between the operation part 8 and the fixing block 4. The card module 3 also includes multiple fins 31 that transfer the heat generated by conductors (not illustrated) provided inside the card edge connector 1. The fins 31, which are provided on both sides of the card module 3, are arranged in a matrix-like manner.

Engagement mechanisms L are respectively provided on front and rear sides (Z1-Z2) of the card edge connector 1. Each of the engagement mechanisms L includes the fixed block 4, the shaft 5, the coil spring 6, and the operation part 8. One of the engagement mechanisms L is positioned on a right edge of the card module 3, and the other one of the pair of engagement mechanisms L is positioned on a left edge of the card module 3. As illustrated in FIG. 1, the engagement mechanism L of the left edge is fixed to the substrate of the card module 3 by a screw 32 screwed from the front side of the substrate of the card module 3. Similarly, the engagement mechanism L of the right edge part is fixed to the substrate of the card module 3 by the screw (not illustrated) screwed from the rear side of the substrate of the card module 3.

Further, a cable connector 33 is provided on an upper side of the right edge part of the card module 3 in FIG. 1. The substrate of the card module 3 includes multiple conductors (not illustrated) that electrically connect the cable connector 33 with multiple pads 34 arranged at an edge part 3*a* of the card module 3. The connector 2 includes multiple contacts 22 corresponding to the multiple pads 34.

The lock 7 includes a radial part 7*a* extending in a radial direction of the shaft 5, an axial part 7*b* extending in an axial direction of the shaft 5, and a tangential part 7*c* extending in a tangential direction with respect to a circumference of the shaft 5. Further, the lock 7 includes a protruding part 7*d* that protrudes from a distal end of the tangential part 7*c* in the removing direction SO. In the connector 2, a recess 21*a* corresponding to the protruding part 7*d* is provided in the target engagement part 21. The recess 21*a* is recessed in the removing direction SO. In the first embodiment, the recess 21*a* may be formed as a through hole penetrating the target engagement part 21 in the removing direction SO.

Figure 2B:
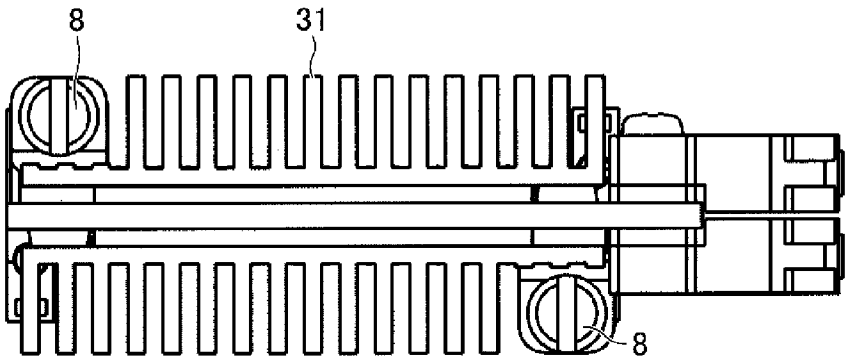
FIGS. 2A-2C are schematic diagrams illustrating the card edge connector according to the first embodiment of the present invention.
Figure 2A:
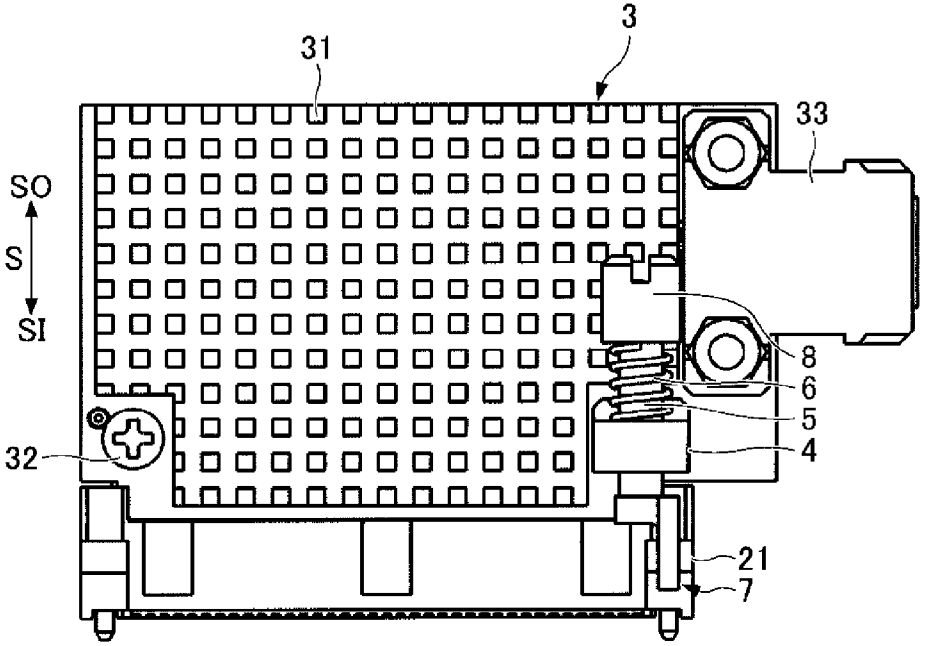
Figure 2C:
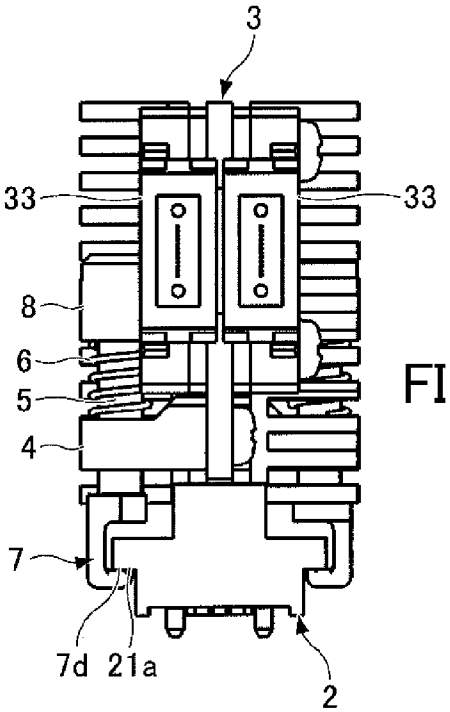

The axial part 7*b* is deviated (offset) in a radial direction with respect to the shaft 5. Further, as illustrated in FIG. 1 and FIG. 2B (which is an upper plan view of FIG. 2A), locks 7 and target engagement parts 21 are provided in multiple areas of the card edge connector 1 and arranged diagonally from each other when viewed from the insertion/removal direction S. When the lock 7 is engaged with the target engagement part 21, the protruding part 7*d* is inserted into the recess 21*a* as illustrated in FIG. 2C.

Figure 3:
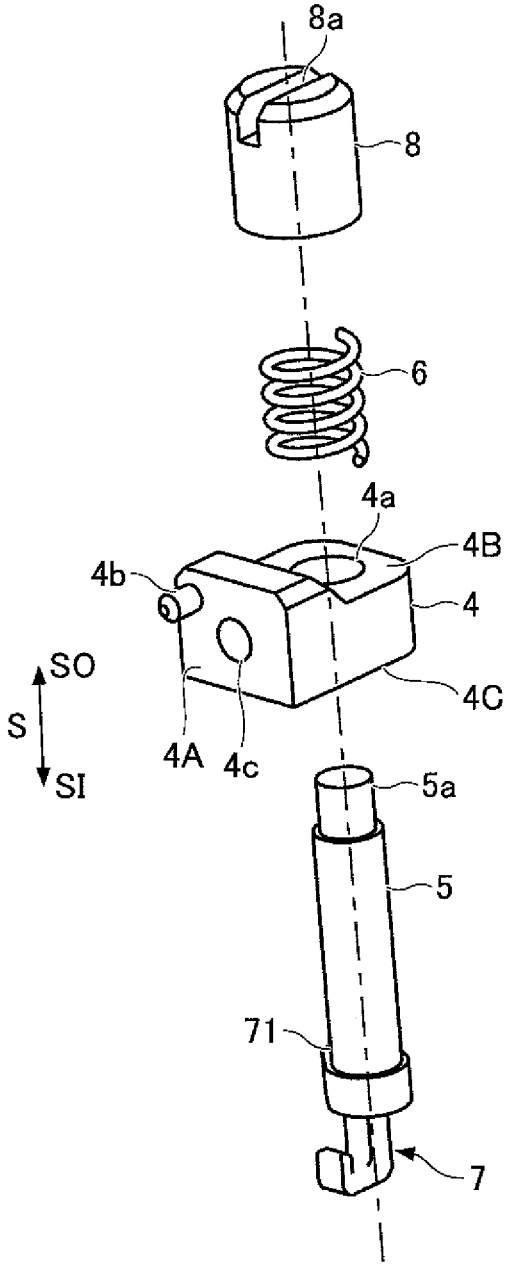
FIG. 3 is an exploded view of a lock of a substrate of the card edge connector according to the first embodiment of the present invention.

As illustrated in FIG. 3, the lock 7 includes a stopper 71 that prevents the shaft 5 from escaping from the fixing block 4 in the removal direction SO by contacting a side of the fixing block 4. The shaft 5 and the lock 7 may be integrally formed or separately formed and coupled to each other, from synthetic resin or metal for example. The shaft 5 includes an external screw 5*a* formed on an end of the shaft 5 toward the removing direction SO.

The shaft 5 has an outer diameter that enables the shaft 5 to be inserted through the insertion hole 4*a* of the fixing block 4. The fixing block 4 includes a fixing surface 4A which is to be fixed to the substrate of the card module 3. The fixing surface 4A includes a positioning pin 4*b* and a screw hole 4*c* into which the screw 32 is fastened. The fixing block 4 also includes a seat surface 4B that receives an urging force exerted by the coil spring 6. The seat surface 4B is provided on a side of the fixing block 4 toward the removing direction SO in a position separated from the fixing surface 4A. The operation part 8 has a circular column shape. A groove 8*a* corresponding to a flat head screw driver is formed on an apex of the operation part 8. Further, an internal screw (not illustrated) corresponding to the external screw 5*a* is formed on a bottom of the operation part 8. The operation part 8 may be formed from, for example, synthetic resin or metal.

Figure 4:
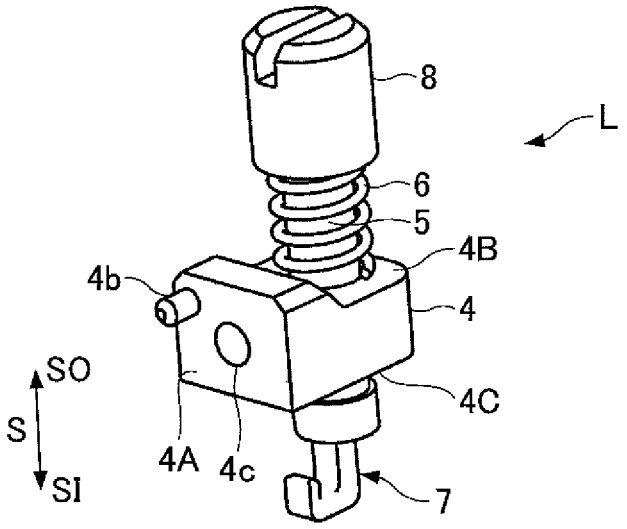
FIG. 4 is a perspective view of the lock of the substrate of the card edge connector according to the first embodiment of the present invention.

After inserting the shaft 5 through the insertion hole 4*a* of the fixing block 4 and inserting the coil spring 6 through the shaft 5 from the external screw 5*a* protruding from the insertion hole 4*a*, the internal screw part of the operation part 8 is fastened to the external screw 5*a*. Thereby, as illustrated in FIG. 4, the engagement mechanism L to be fixed to the substrate of the card module 3 is provided.

Figure 5D:
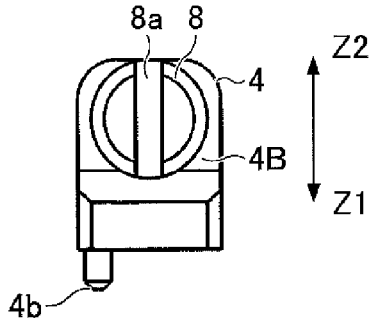
FIGS. 5A-5E are schematic diagrams illustrating the lock of the substrate of the card edge connector according to the first embodiment of the present invention.
Figure 5C:
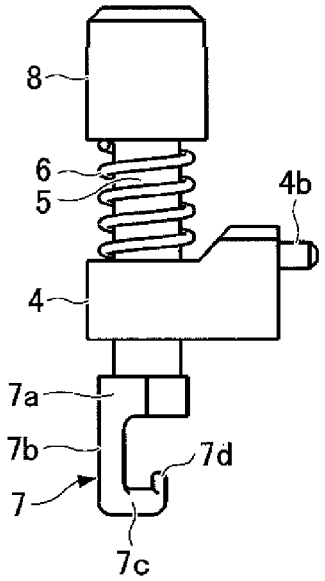
Figure 5A:
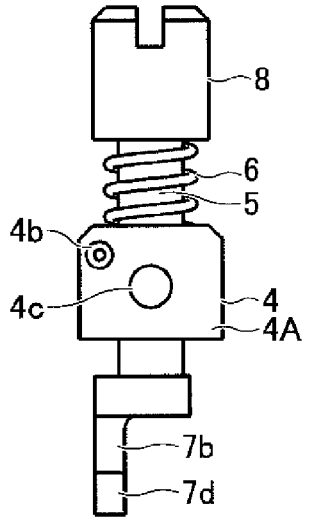
Figure 5B:
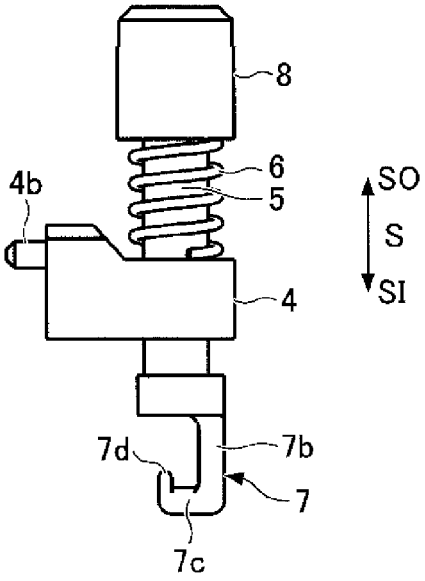
Figure 5E:
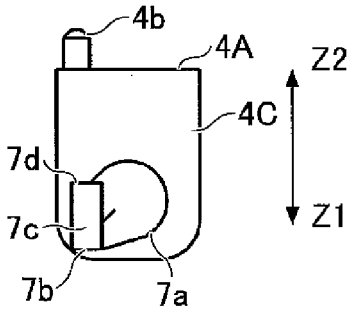
Figure 7B:
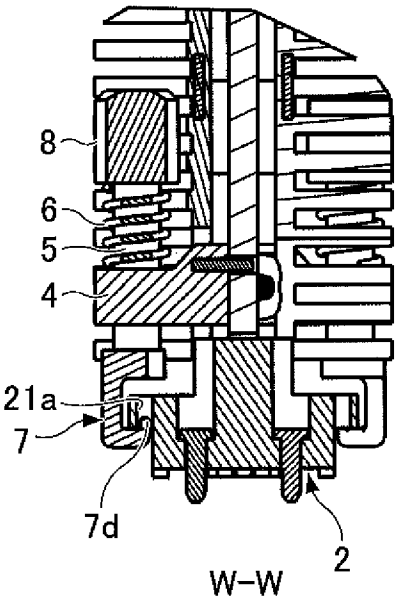
FIG. 7B is a cross-sectional view taken along line W-W of FIG. 7A.
Figure 7A:
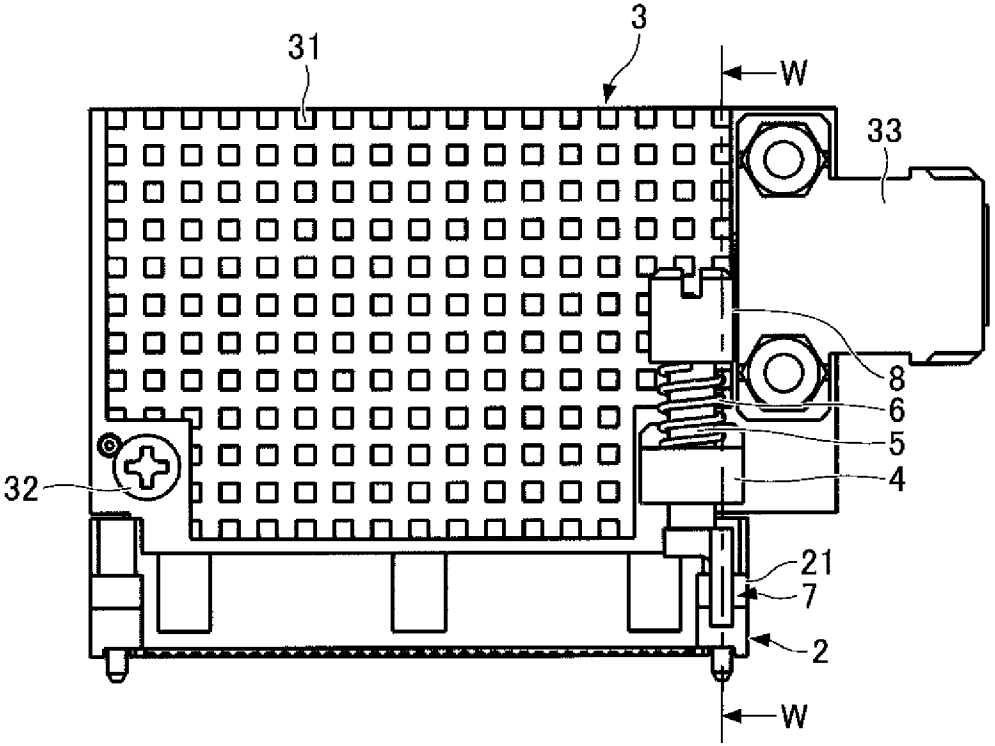
FIG. 7A is a front view illustrating an engaged state between a target engagement part and the lock of the card edge connector according to the first embodiment of the present invention.
Figure 8B:
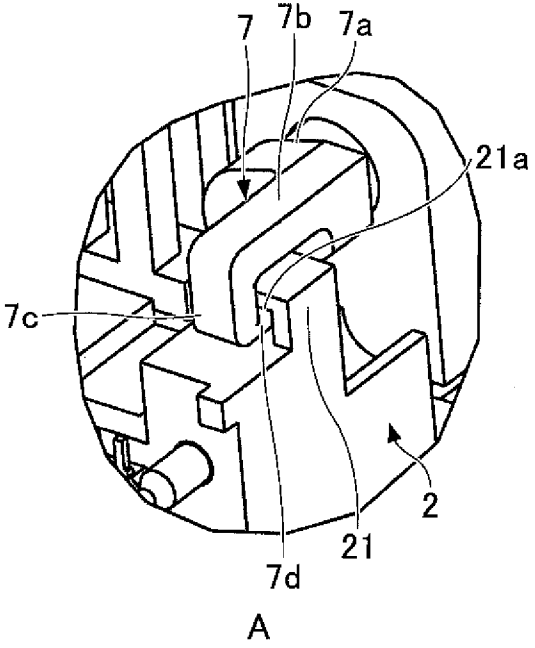
FIG. 8B is an enlarged view of a portion A of FIG. 8A.
Figure 8A:
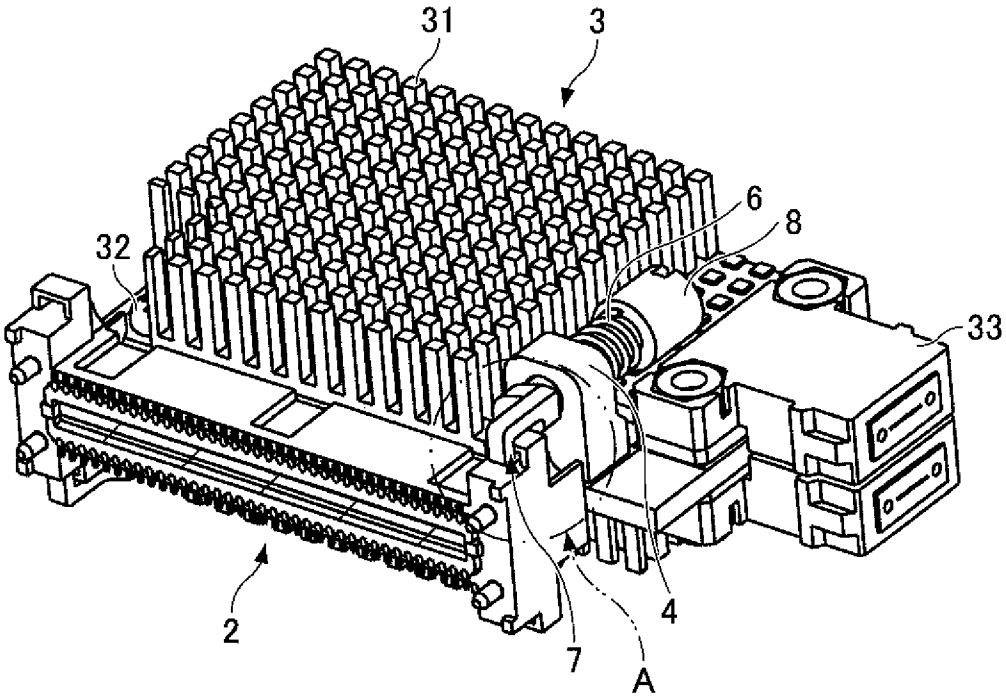
FIG. 8A is a perspective view illustrating an engaged state between the target engagement part and the lock of the card edge connector when viewed from the connector according to the first embodiment of the present invention.
Figure 9B:
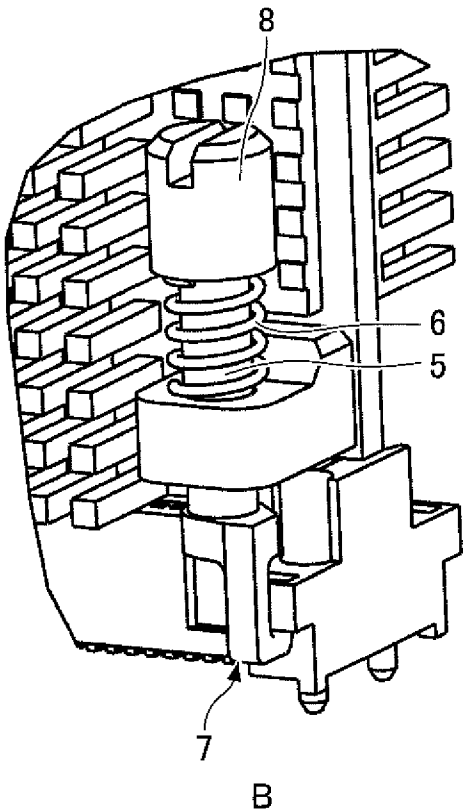
FIG. 9B is an enlarged view of a portion B of FIG. 9A.
Figure 9A:
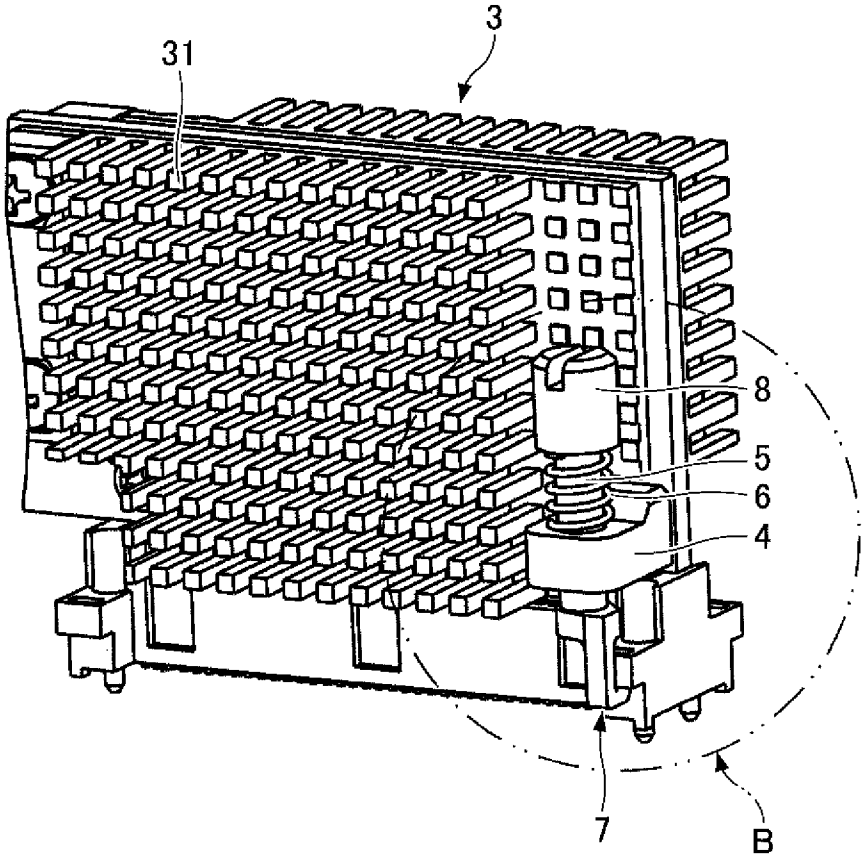
FIG. 9A is a perspective view illustrating an engaged state between the target engagement part and the lock of the card edge connector when viewed from an operation part according to the first embodiment of the present invention.

FIGS. 5A-5D are schematic diagrams illustrating the engagement mechanism L of the left edge of the card module 3 on the rear side in FIG. 1. FIG. 5A is a front view of the engagement mechanism L illustrating the fixing surface 4A to be fixed to the substrate 3 of the card module 3. FIG. 5B is a right side view of the engagement mechanism L. FIG. 5C is a left side view of the engagement mechanism L. FIG. 5D is a plan view of the engagement mechanism L viewed in the insertion direction SI. FIG. 5E is a plan view of the engagement mechanism L viewed in the removal direction SO. As illustrated in FIG. 5E, the protruding part 7*d* is positioned closer to an axis of the shaft 5 than the axial part 7*b*.

The radial part 7*a*, the axial part 7*b*, and the tangential part 7*c* of the lock 7 of the first embodiment function to adjust a three-dimensional position of the protruding part 7*d* for engaging the protruding part 7*d* with the recess 21*a* of the target engagement part 21 from a front side or a rear side of the card edge connector 1. The extending direction of the tangential part 7*c*, extending in a direction Z1-Z2 in FIG. 5E, is tangential to the circumference of the shaft 5.

FIGS. 6A-6E illustrate the connector 2 of FIG. 1. FIG. 6A is a front view of the connector 2 viewed from a front side of the card module substrate 3. FIG. 6B is a plan view of the connector 2 from the removal direction SO. FIG. 6C is a plan view of the connector 2 from the insertion direction SI. FIG. 6D is a right side view of the connector 2. FIG. 6E is a perspective view of the connector 2 viewed from a side in which the contacts 22 are arranged in an engagement hole 23. The engagement hole 23 engages with the edge part 3*a* of the card module 3 having the pads 34 arranged therein. As illustrated in FIGS. 6A-6E, the target engagement parts 21 are integrally formed with the connector 2 by using a synthetic resin. The target engagement parts 21 are formed protruding from the right edge on the front side and the left edge on the rear side. In the embodiment illustrated in FIGS. 6A-6E, auxiliary target engagement parts (21) are provided on opposite sides with the engagement hole 23 interposed therebetween.

After the card module 3 is inserted into the connector 2, a worker uses a flat head screw driver to press the operation part 8 in the insertion direction SI and rotate the operation part 8, in a counter-clockwise direction. The shaft 5 and the lock 7 of the engagement mechanism L are thrust in the insertion direction SI against the urging force of the coil spring 6 and rotated in a counter-clockwise direction around its as illustrated in FIG. 1. When the worker stops pressing and rotating the operation part 8 in a state where the protruding part 7*d* is positioned on a side of the recess 21, the protruding part 7*d* can be inserted into the recess 21, and the lock 7 engages with the engagement part 21.

As illustrated into FIGS. 7A to 9B, the protruding part 7*d* is inserted to the recess 21*a*, and the lock 7 is engaged with the target engagement part 21. By engaging the locks 7 and the target engagement parts 21 arranged on the card edge connector 1 diagonally with each other from a plan view, the card module 3 can be fixed to the connector 2. As illustrated in FIG. 7B, the length of the protruding part 7*d* in the insertion/removal direction S is shorter than the length of the through hole of the recess 21*a*. Thereby, a pressing operation to be performed by the worker is minimal. FIG. 7B is a cross-sectional view taken along line W-W of FIG. 7A.

On the other hand, in a case of pulling out and removing the card module 3 from the connector 2, a worker uses a flat head screw driver to press the operation part 8 in the insertion direction SI and rotate the operation part 8 in a clockwise direction. Then, the protruding part 7*d* of the lock 7 is removed from the recess 21*a* of the target engagement part 21. Thus, the engagement of the lock 7 and the target engagement part 21 is released.

Hence, with the card edge connector 1 of the first embodiment, the following effects can be attained. That is, with the first embodiment, the lock 7 is engaged with the target engagement part 21 and the card module 3 can be fixed to the connector 2, by rotating the operation part 8 separately from the insertion/removal operation of the card module 3 being pressed or pulled in the insertion/removal direction S.

Unlike fixing a substrate as described in Japanese Laid-Open Utility Model Publication No. 6-86278 in which latch type levers are fixed to notches of the substrate by pivotally rotating and engaging the levers with the notches, the card edge connector 1 of the first embodiment requires no clearance to be provided between the notches and protrusions in the direction S. That is, the card edge connector 1 of the first embodiment does not need to take looseness into consideration. Accordingly, a branched portion, or a stub, which could become a by-pass of a signal transmission path, can be prevented from being formed in the insertion direction SI at contact points between pads and contacts. Thereby, high speed transmission performance can be increased.

Further, with the aforementioned related art of engaging the latch type levers with the notches provided on the sides of the substrate, a clearance is required to be formed in the insertion/removal direction S. Therefore, supposing that the lengths of the pads 34 were to be shortened in the insertion/removal direction, it would be necessary to increase a sliding length between the pads 34 and the contacts 22 for ensuring electric contact between the pads 34 and the contacts 22. However, with the first embodiment, contact reliability can be increased even where the lengths of the pads 34 are shortened because no clearance is required.

Further, in engaging with the latch type levers according to the related art, a space for accommodating a hand or a finger of a worker is required to operate the levers. However, the card edge connector 1 of the first embodiment can be formed without such space for the worker.

Particularly, in a case where the cable connector 33 is arranged on a plane orthogonal to the insertion/removal direction S as illustrated in FIG. 1, the worker does not need to place his/her finger or hand toward the insertion direction SI beyond the cable connector 33. Further, the latch type levers according to the related art may not be able to perform engagement depending on, for example, the size of the cable connector 33 or the hand of the worker. However, such difficulty does not occur with the card edge connector 1 of the first embodiment, and operability can be enhanced and cost reduction can be achieved.

Second Embodiment

In the first embodiment, the lock 7 includes the radial part 7*a*, the axial part 7*b*, and the tangential part 7*c* formed in this order from the side that the shaft 5 is provided. However, this order may be arbitrarily changed as described in the following second embodiment.

Figure 10:
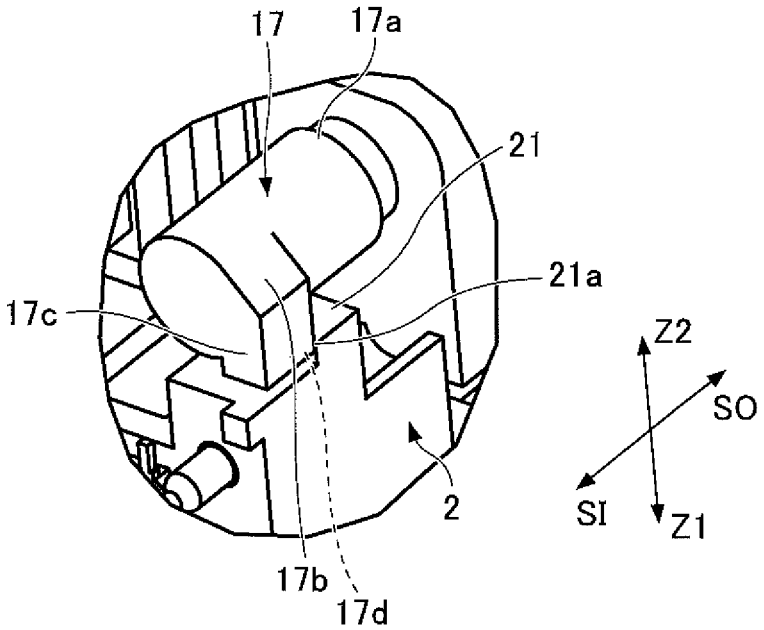
FIG. 10 is a perspective view illustrating an engaged state between a target engagement part and a lock of a card edge connector according to a second embodiment of the present invention.

Because the configuration of a card edge connector of the second embodiment illustrated in FIG. 10 is substantially the same as the above-described configuration of the first embodiment except for a lock 17, the differences between the first and second embodiments are mainly described below. The lock 17 of the second embodiment includes an axial part 17*a* having a diameter greater than a diameter of the shaft 5, a radial part 17*b*, and a tangential part 17*c*. Similar to the lock 7*d* of the first embodiment, the lock 17 may also include a protruding part 17*d* to be inserted to the recess 21*a* of the target engagement part 21.

The axial part 17*a*, the radial part 17*b*, and the tangential part 17*c* of the lock 17 of the second embodiment also function to adjust a three-dimensional position of the protruding part 17*d*, so that the protruding part 17*d* engages the recess 21*a* of the target engagement part 21 on the front or rear side of the card edge connector 1. The extending direction of the tangential part 17*c*, extending in the direction Z1-Z2 in FIG. 10, is tangential to a circumference of the shaft 5.

Hence, similar to the first embodiment, the card edge connector of the second embodiment can also attain the following effects. That is, in the second embodiment, the lock 17 is engaged with the target engagement part 21 by rotating the operation part 8 separately with the insertion operation of the card module 3, and the card module 3 can be fixed to the connector 2.

With the second embodiment, branched portions, which could become by-passes of a signal transmission path, can be prevented from being formed at contact points between pads and contacts in the insertion direction SI. Accordingly, high speed transmission performance can be increased. With the second embodiment, contact reliability can be increased even where the lengths of the pads 34 are shortened. With the second embodiment, the card edge connector 1 can be formed without a space for accommodating a hand or a finger of a worker. Thereby, operability can be enhanced and cost reduction can be achieved.

Hence, the above-described embodiment of the present invention relates to a card edge connector that can fix a substrate to a connector by engaging an engagement part with a target engagement part according to a rotation of the engaging part performed separately from an insertion/removal operation. Unlike fixing a substrate with latch type levers fixed to notches of the substrate by engaging the levers with the notches, the card edge connector of the embodiment requires no clearance to be provided between the notches and protrusions in the direction S. That is, the card edge connector of the embodiment does not need to take looseness into consideration. Accordingly, a branched portion (a stub) which could become a by-pass of a signal transmission path can be prevented from being formed in the insertion direction at contact points between pads and contacts. Thereby, high speed transmission performance can be increased. Thus, the above-described embodiment of the card edge connector can be used for electronic devices in homes, offices, or vehicles desired to perform high speed transmission.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

For example, although the operation part 8 of the above-described embodiment is described to be used for a flat head screwdriver, the operation part may a thumbscrew to be operated with a finger. In this case, the operation part may be arbitrarily extended toward the removing direction SO. Further, the cable connector may be positioned in a direction oriented in the insertion/removal direction S.

What is claimed is:

1. A card edge connector comprising:

a connector including a target engagement part;

a substrate that can be inserted into and removed from the connector;

a fixing part fixed to the substrate; and a lock that secures the substrate to the connector, the lock includes a shaft fixed to the fixing part and configured to slide in the direction of insertion and removal of the substrate and rotate around an axis;

an urging part that exerts force on the shaft and biasing the shaft toward a direction of removal of the substrate from the connector; and an engagement part provided on the shaft and having a hook shape configured to engage the target engagement part.

2. The card edge connector as claimed in claim 1, wherein the hook shape includes a first radial part extending in a radial direction of the shaft, an axial part extending from the first radial part in an axial direction of the shaft and a second radial part extending from the axial part in the radial direction of the shaft.

3. The card edge connector as claimed in claim 1, wherein the target engagement part includes a recess that is recessed in the removal direction, and the engagement part further includes a protruding part protruding from a distal end of the engagement part, that engages with the recess.

4. The card edge connector as claimed in claim 2, wherein the axial part is offset in a radial direction with respect to the shaft.

5. The card edge connector as claimed in claim 1, wherein a plurality of the locks are provided in a different area of the substrate and a plurality of the target engagement parts are provided in a different area of the card edge connector, respectively, wherein one of the engagement part and the target engagement part is arranged diagonally from another one of the engagement part and the target engagement part when viewed from the insertion/removal direction.

6. The card edge connector as claimed in claim 1, further comprising:

an operation part provided on the shaft.

7. The card edge connector as claimed in claim 6, wherein the urging part is secured between the operation part and the fixing part.

8. A card type module for being inserted into and removed from a connector, the card type module comprising:

a substrate;

a fixing part fixed to the substrate;

a shaft rotatably fixed to the fixing part, configured to slide in a direction of insertion and removal of the card type module;

an urging part that exerts force on the shaft in a direction of removal of the card type module from the connector; and an engagement part provided on the shaft and having a hook shape;

wherein the engagement part is configured to engage to a portion of the connector by a rotation of the shaft.

9. A connector to which a substrate is insertable, said substrate having a fixing part fixed to the substrate; and a lock that secures the substrate to the connector, the lock including:

a shaft fixed to the fixing part and configured to slide in the direction of insertion and removal of the substrate and rotate around an axis;

an urging part that exerts force on the shaft and biases the shaft toward a direction of removal of the substrate from the connector; and an engagement part provided on the shaft and having a hook shape configured to engage a target engagement part of the connector, the connector comprising:

the target engagement part configured to engage the hook shape of the engagement part of the substrate;

wherein the engagement part is configured to slide in a direction in which the substrate is inserted, and rotate around the shaft.

* * * * *